US005997407A

United States Patent [19]

Alexandres

[11] Patent Number: 5,997,407

[45] Date of Patent: Dec. 7, 1999

[54] GOLF VENT

[76] Inventor: Jon K. Alexandres, 420 Prairie View La., Mason City, Iowa 50401

[21] Appl. No.: 09/188,134

[22] Filed: Nov. 9, 1998

Related U.S. Application Data

[60] Provisional application No. 60/084,240, May 5, 1998.

[51] Int. Cl.[6] ..... A63B 69/36

[52] U.S. Cl. ..... 473/180

[58] Field of Search ..... 473/180–189, 473/175, 179, 173, 174, 176–178; 454/289–291

[56] References Cited

U.S. PATENT DOCUMENTS 5,120,063 6/1992 Birchler et al. .

5,205,559 4/1993 Plopper ..... 473/179

5,275,405 1/1994 Ridge .

5,620,375 4/1997 Frotten .

*Primary Examiner*—Mark S. Graham

*Attorney, Agent, or Firm*—G. Brian Pingel

[57] ABSTRACT

A golf putting practice device adapted to serve as a substitute for a floor vent that fits into a floor duct of a forced air circulation system of a building and includes a ball receiving enclosure and at least one flat support plate member extended outwardly from the ball receiving enclosure. The front wall of the ball receiving enclosure includes a notched portion that provides a golf ball open access to the enclosure when the device is installed into a floor duct. A plurality of apertures are formed in the support plate member to allow for air flow through the plate.

8 Claims, 3 Drawing Sheets

GOLF VENT

REFERENCE TO RELATED APPLICATION

This application claims the benefit of U.S. Provisional Application No. 60/084,240, filed May 5, 1998.

BACKGROUND OF THE INVENTION

1. Field of the Invention

The present invention relates in general to a golf putting practice device and more particularly to such a practice device that fits into the floor duct of a forced air circulation system of a building.

2. Description of the Prior Art

A wide variety of golf putting practice devices are known in the prior art. Many such devices are designed to sit on the surface of a floor for putting practice. However, such practice devices include a ramped sidewall that leads up to a putting cup and, therefore, are not truly representative of putting on a golf green.

To overcome the deficiency of ramped golf practice devices, there have been developed in the prior art practice devices that are adapted to fit into the floor duct of a forced air circulation system of a building such as those disclosed in U.S. Patents to Birchler, et al., U.S. Pat. No. 5,120,063; Ridge, U.S. Pat. No. 5,275,405 and Frotten, U.S. Pat. No. 5,620,375. Although the golf practice devices disclosed in these patents substantially eliminate the need for a ramped sidewall, they all are formed from flat support plates that surround a ball receiving portion of the device, which flat plates provide an obstruction to such portion.

To lessen this problem, the Frotten patent discloses a golf practice device fabricated of a resilient material so that the device can be installed in a floor duct by bending the support plate for insertion underneath the carpet surrounding the duct. Although such configuration is an improvement in reducing obstruction to the ball receiving portion, the Frotten practice device cannot readily be moved from one vent to another and depending on the thickness of the carpet under which it is installed, the path to the cup is not completely level.

The present invention is designed to provide a golf putting practice device that overcomes the deficiencies of the foregoing prior art.

SUMMARY OF THE INVENTION

The present invention provides a golf putting practice device adapted to serve as a substitute for a floor vent that fits into a floor duct of a forced air circulation system of a building. The practice device includes a ball receiving means having a front wall and two opposite sidewalls, which sidewalls are each attached to flat support plate members extended perpendicularly outward from the sidewall upper portions. The front wall of the ball receiving means includes an upper notched portion that provides a golf ball open access to the receiving means and the plate members include a plurality of apertures for the passage of air therethrough.

Preferably, the support plate members are generally equal in size so that the ball receiving means is located medially of the practice device. The support plate members and ball receiving means are sized so that the device generally conforms to the size of the floor duct in which it is to be installed. The support plate members further include a peripheral flange that overlies the circumference of the floor duct to support the device on the floor.

The foregoing and other advantages of the present invention will appear from the following description. In the description, reference is made to the accompanying drawings, which form a part hereof, and in which there is shown by illustration, and not of limitation, a specific form in which the invention may be embodied. Such embodiment does not represent the full scope of the invention, but rather the invention may be employed in a variety of embodiments, and reference is made to the claims herein for interpreting the breadth of the invention.

DETAILED DESCRIPTION OF THE PREFERRED EMBODIMENT

Figure 1:
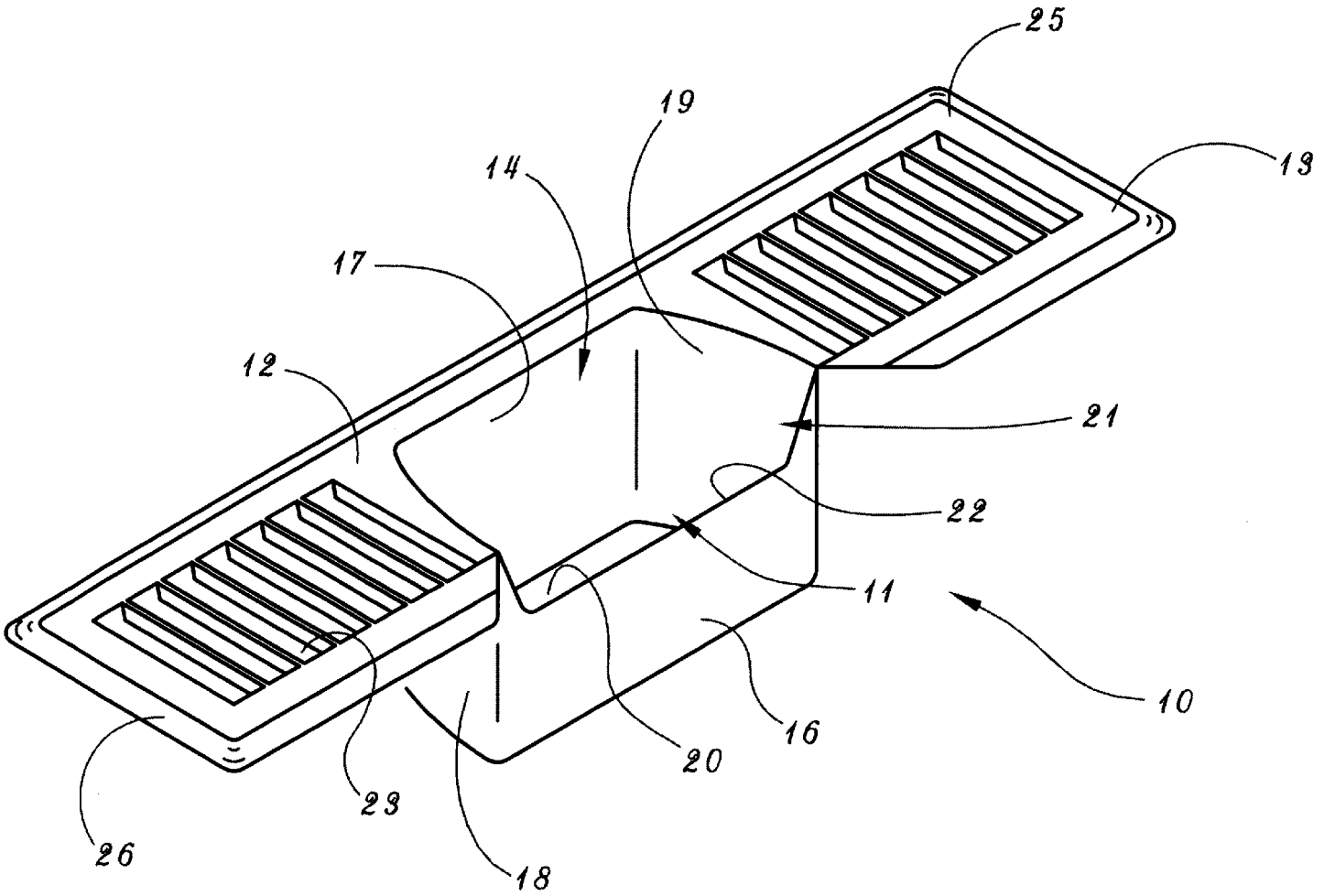
FIG. 1 is a front perspective view of a preferred embodiment of the golf putting practice device of the present invention.

Referring now to the drawings and with reference first to FIG. 1, a golf putting practice device of the present invention is shown at 10 and is adapted to serve as a substitute for a floor vent that fits into a floor duct of a forced air circulation system of a building. The device 10 is preferably integrally formed with a ball receiving means 11 and a pair of generally flat support plate members 12 and 13 that are less than 2 millimeters thick.

Although the device 10 can be formed of plastic, such as in an injection molded process, it has been found that when made of flat sheet steel, the entire device can be manufactured by means of a stamp process that allows for manufacturing and production economies and advantages, and duplicates the production process of most standard floor vents. Of course, one skilled in the art can envision alternate materials of and processes for constructing the device 10 in accordance with the present invention based upon the teachings of the present disclosure.

The ball receiving means 11 is formed of a generally cup shaped configuration and includes front and rear walls 16 and 17 respectively, opposite sidewalls 18 and 19, a bottom wall 20 and an open top 21. As shown best in FIG. 1, the upper portion of the front wall 16 is formed with a notched portion 22.

Figure 2:
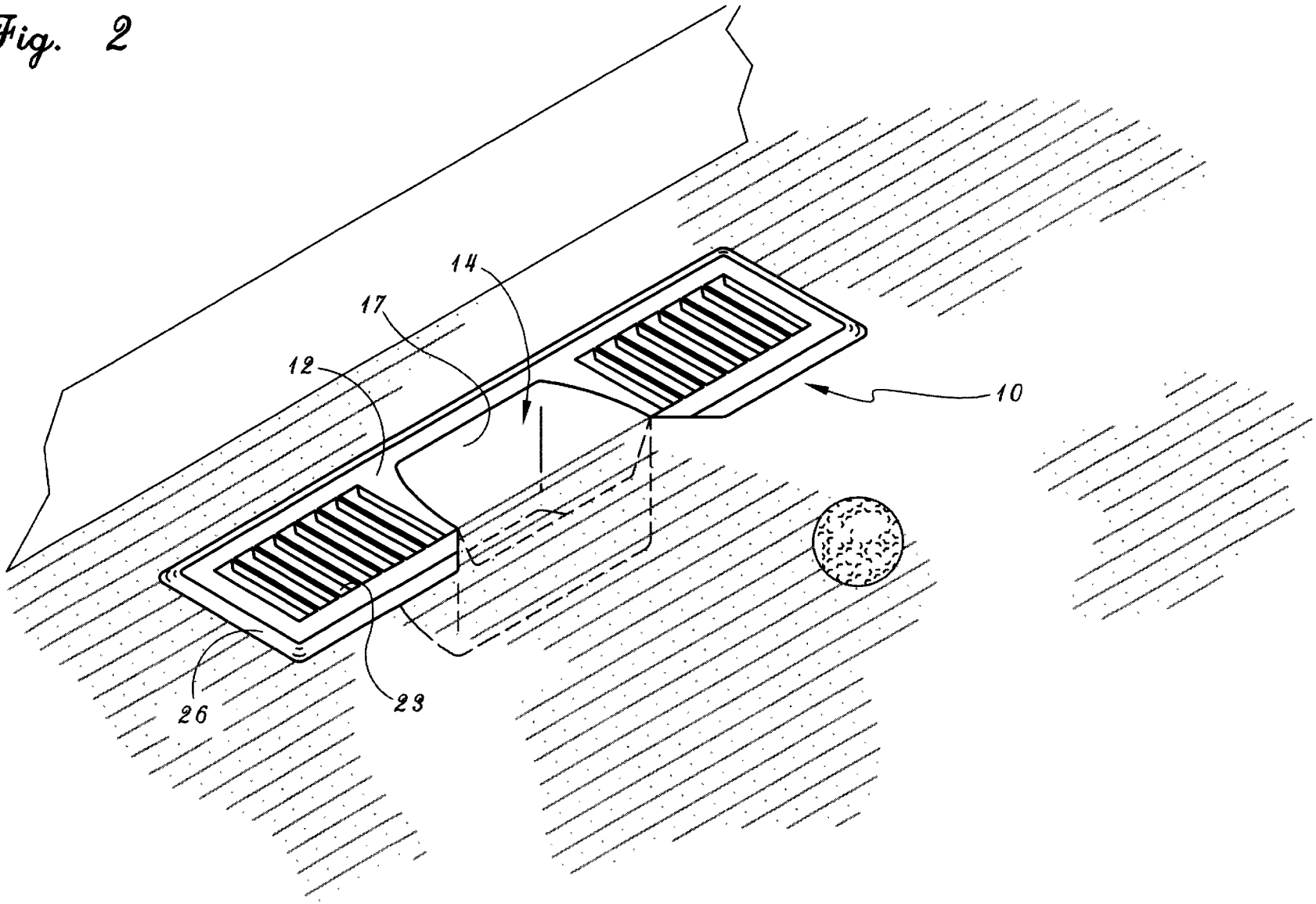
FIG. 2 is a perspective view of the putting device of FIG. 1 installed within a floor vent opening.

Each of the support plates 12 and 13 is generally elongated and rectangular in shape, with a radius curve at each corner to prevent snagging or injury. The plates 12 and 13 extend outwardly from the upper portions of the sidewalls 18 and 19 respectively in perpendicular fashion and as shown by FIG. 2, the side plates 12 and 13 and the ball receiving means 11 are sized so that the device 10 fits within a floor duct of a forced air circulation system, as shown in FIG. 2. In the preferred embodiment, the plates 12 and 13 are of the same length so that the ball receiving means is generally centered in the device 10. However, it would be possible to vary the location of the receiving means by making the plates 12 and 13 of different lengths or to have only one of the support plates 12 and 13, thereby placing the receiving means at one end of the device 10.

Figure 3:
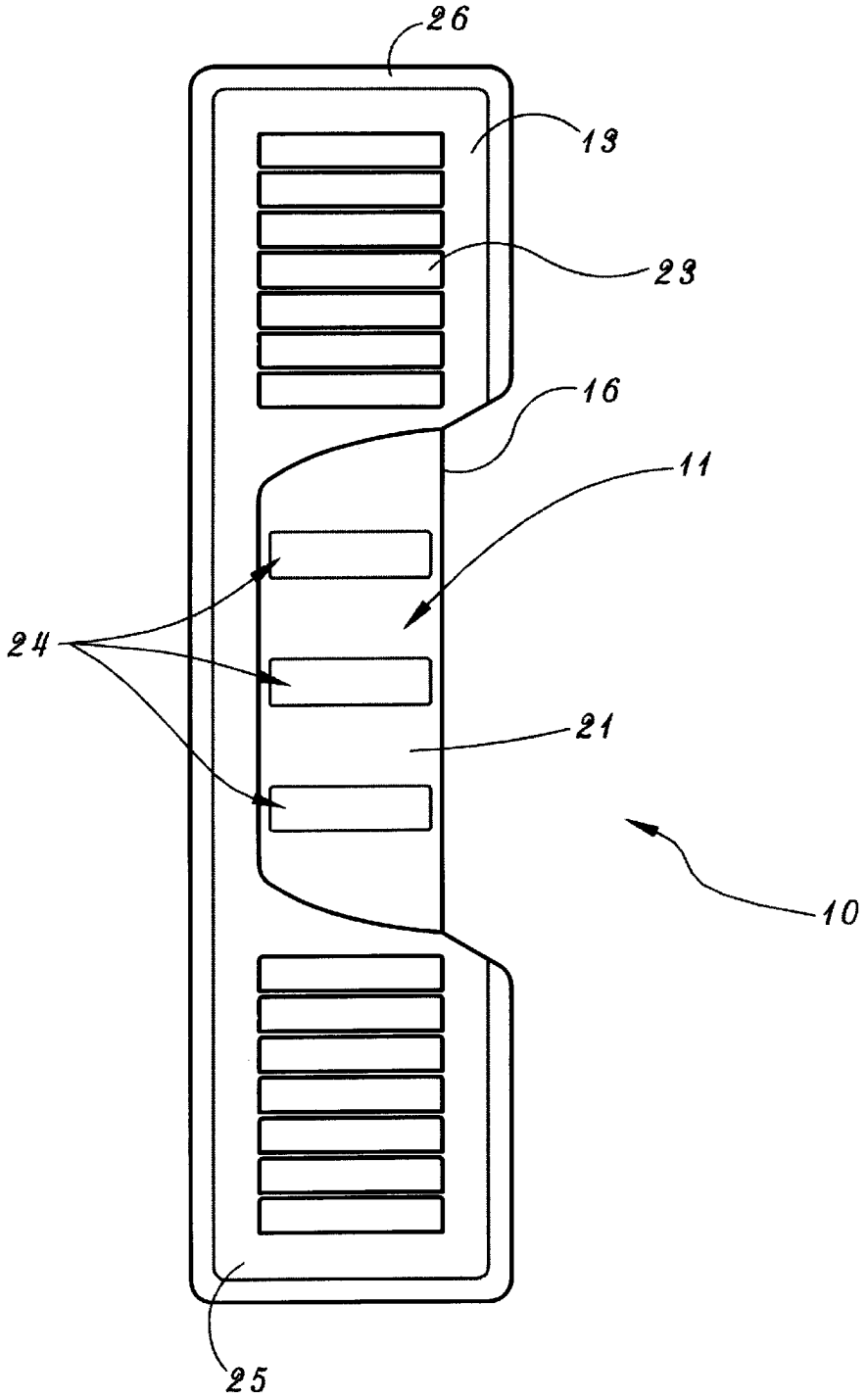
FIG. 3 is a plan view of the putting practice device of FIG. 1.

Preferably, the support plates 12 and 13 have a plurality of apertures 23 in parallel alignment with one another to provide for the passage of air out of the floor duct just as a standard duct vent would do. It may also be advantageous in terms of air flow to have apertures 24 in the bottom wall 20 of the ball receiving means 11, as shown in FIG. 3. The support plates 12 and 13 together with the ball receiving means 11 form a peripheral flange 25 about the device 10 for coacting with the circumference of the floor duct to maintain the device 10 in position seated in the duct opening. The flange 25 is formed with a beveled lip 26 that not only adds rigidity to such flange, but also provides an aesthetically pleasing "finished" look to the final product.

In operation of the device 10, the user merely substitutes such device for an existing floor duct vent. In a passive manner, the device 10 functions sufficiently as would the replaced vent. When users wish to practice their putting skills, the recessed portion 22 of the front wall 16 serves as a putting target and a golf ball can roll directly into the ball receiving means 11 as a result of the notched portion 22.

Although the invention has been described with respect to a preferred embodiment thereof, it is to be understood that it is not to be so limited, since changes and modifications can be made therein which are within the full intended scope of this invention as defined by the appended claims. For example, the size of the ball receiving means can be increased or reduced in size as well as its notched front wall.

What is claimed is:

1. A golf putting practice device adapted to serve as a substitute for a floor vent that fits into a floor duct of a forced air circulation system of a building, said device comprising:

(a) a ball receiving means having front and rear walls, opposite side walls, a closed bottom and a substantially open top;

(b) a pair of flat support plate members, each extended perpendicularly outward from an upper portion of one of said opposite sidewalls of said receiving means, said plate members having a plurality of apertures for the passage of air therethrough; and (c) said front wall of the ball receiving means having an upper notched portion that provides a golf ball open access to said ball receiving means when the device is installed into a floor duct.

2. The golf putting practice device of claim 1, wherein the support plate members and the rear wall of the ball receiving means form a peripheral flange that rests upon the circumference of a floor duct.

3. The golf putting device of claim 1, wherein said support plate members are equally sized so that when the device is fit into a floor duct, the ball receiving means is generally centered therein.

4. A golf putting practice device as recited in claim 1 wherein said ball receiving means and support plate members are sized according to the size of a floor duct into which said device fits.

5. A golf putting practice device as recited in claim 1, wherein said plate members and the open top of said ball receiving means lie in the same plane.

6. A golf putting practice device as recited in claim 1, wherein said ball receiving means is of a generally cup shaped configuration.

7. A golf putting practice device adapted to serve as a substitute for a floor vent that fits into a floor duct of a forced air circulation system of a building, said device comprising:

(a) a ball receiving means having a front and rear wall, opposite sidewalls, a closed bottom and a substantially open top;

(b) at least one flat support plate member extended perpendicularly from an upper portion of at least one opposite sidewall, said plate member having a plurality of apertures for the passage of air therethrough; and (c) said front wall of the ball receiving means having an upper notched portion that provides a golf ball open access to said ball receiving means when the device is installed into a floor duct.

8. A golf putting device as recited in claim 7, wherein said closed bottom of the ball receiving means has at least one aperture for the passage of air therethrough.

* * * * *